US008769775B2

(12) United States Patent
Räntfors

(10) Patent No.: US 8,769,775 B2
(45) Date of Patent: Jul. 8, 2014

(54) BUTTON FASTENER AND METHOD OF FASTENING A BUTTON

(75) Inventor: Karolina Räntfors, Göteborg (SE)

(73) Assignee: Tic Sverige Aktiebolag, Gothenburg (SE)

( * ) Notice: Subject to any disclaimer, the term of this patent is extended or adjusted under 35 U.S.C. 154(b) by 335 days.

(21) Appl. No.: 13/058,198

(22) PCT Filed: Aug. 26, 2009

(86) PCT No.: PCT/SE2009/050956
§ 371 (c)(1),
(2), (4) Date: Feb. 9, 2011

(87) PCT Pub. No.: WO2010/024757
PCT Pub. Date: Mar. 4, 2010

(65) Prior Publication Data

US 2011/0138590 A1 Jun. 16, 2011

(30) Foreign Application Priority Data

Aug. 26, 2008 (SE) ..... 0801832

(51) Int. Cl.
*A44B 1/28* (2006.01)

(52) U.S. Cl.
USPC ..... 24/114.7; 24/90.1

(58) Field of Classification Search
CPC ..... A44B 1/20; A44B 1/34; A44B 5/02; A44B 1/36; A44B 1/44; A44B 1/04; A44B 1/28; A44B 1/18; A47C 31/026; A41F 1/00; A41F 19/00; A41B 3/02; A41B 3/08; A41H 37/003
USPC ..... 24/104, 700, 322.1, 342.1, 367.1, 24/378.1, 379.1, 902, 90.1, 93, 94, 95, 24/106, 110, 114.4, 114.7; 2/265
See application file for complete search history.

(56) References Cited

U.S. PATENT DOCUMENTS 433,182 A 7/1890 Parmelee
1,598,597 A 9/1926 Baggerud
(Continued)

FOREIGN PATENT DOCUMENTS

CH 252191 A 12/1947
DE 2829714 A1 2/1979
(Continued)

OTHER PUBLICATIONS

International Search Report and Written Opinion (mailed Nov. 30, 2009).

*Primary Examiner* — Robert J Sandy
*Assistant Examiner* — Rowland Do
(74) *Attorney, Agent, or Firm* — Jeffrey S. Melcher; Manelli Selter PLLC

(57) ABSTRACT

Provided is a button fastener, having a penetrating part (10) and a receiving part (20), wherein the penetrating part (10) is substantially u-shaped by means of having a transversal base (16) with two parallel legs (15), each of said legs (15) having a pointed end (11; 31) and a protruding retaining member (14;34) adjacent said pointed end arranged to interlock with the receiving part (20), and wherein said receiving part (20) is substantially u-shaped with at least one transversal base (25) and at a position at a distance from said transversal base (25) an interlocking receiving member (22) arranged to interlock with said penetrating part (10), wherein at least one of said parts (10, 20) is arranged with a gripping member (19, 29) which is detachable by means of a line of rupture (17, 27), and a method of fastening buttons.

18 Claims, 9 Drawing Sheets

(56) References Cited

U.S. PATENT DOCUMENTS

| | | | | | |
|---|---|---|---|---|---|
| 2,104,885 | A | * | 1/1938 | Robbins | 24/114.7 |
| 2,574,014 | A | * | 11/1951 | Bryce | 24/111 |
| 3,566,452 | A | * | 3/1971 | Hocker | 24/103 |
| 3,900,925 | A | * | 8/1975 | La Torraca | 24/90.1 |
| 3,925,855 | A | * | 12/1975 | Olovson | 24/90.1 |
| 4,296,698 | A | * | 10/1981 | Davidson et al. | 112/110 |
| 4,773,343 | A | | 9/1988 | Riche | |
| 4,970,766 | A | * | 11/1990 | Hsiau et al. | 24/90.1 |
| 5,518,162 | A | * | 5/1996 | Deschenes et al. | 227/71 |
| 5,584,104 | A | * | 12/1996 | Stuart | 24/114.7 |
| 5,954,242 | A | * | 9/1999 | Deschenes et al. | 223/1 |
| 6,702,162 | B1 | * | 3/2004 | Hassid | 223/1 |

FOREIGN PATENT DOCUMENTS

| | | | |
|---|---|---|---|
| GB | 19107663 | A | 6/1910 |
| GB | 19151945 | A | 8/1915 |
| JP | 2007229150 | A | 9/2007 |
| WO | 9948398 | A1 | 9/1999 |

* cited by examiner

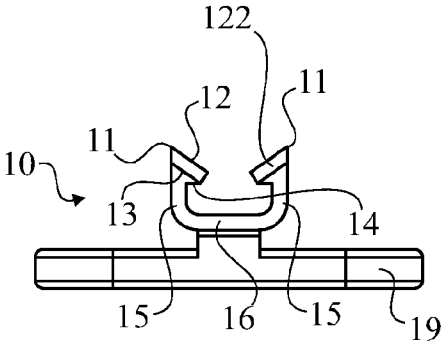
Fig. 1
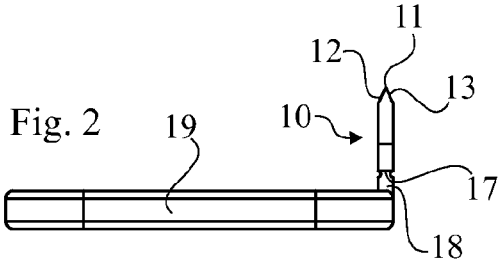
Fig. 2
Fig. 3
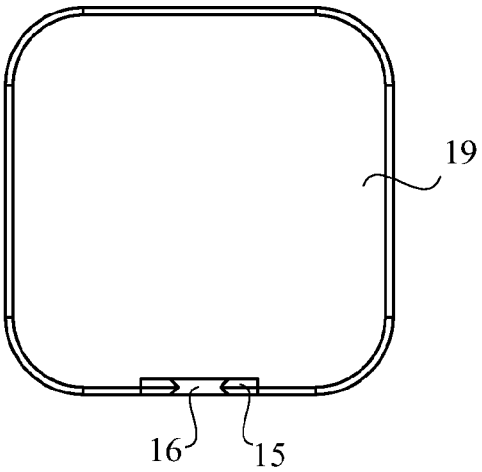
Fig. 4
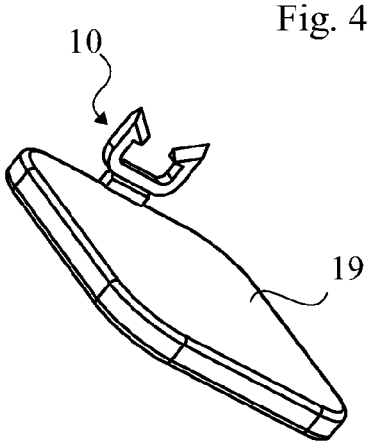

Fig. 5
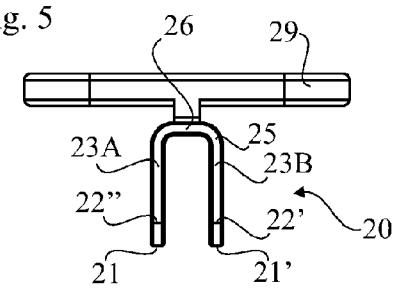
Fig. 6
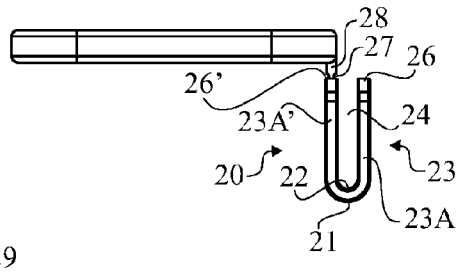
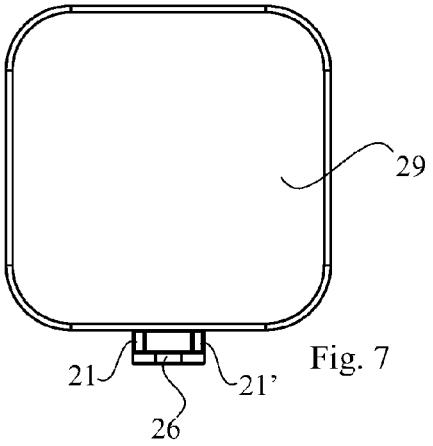
Fig. 7
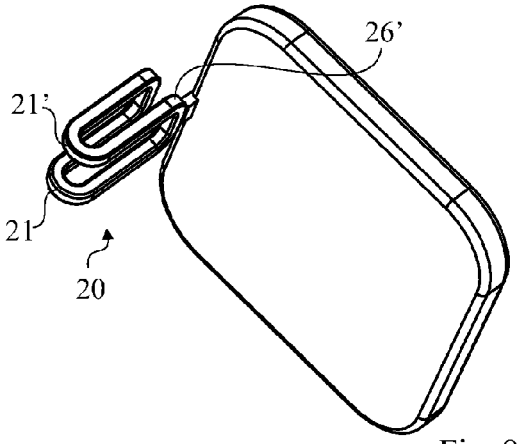
Fig. 8

Fig. 16
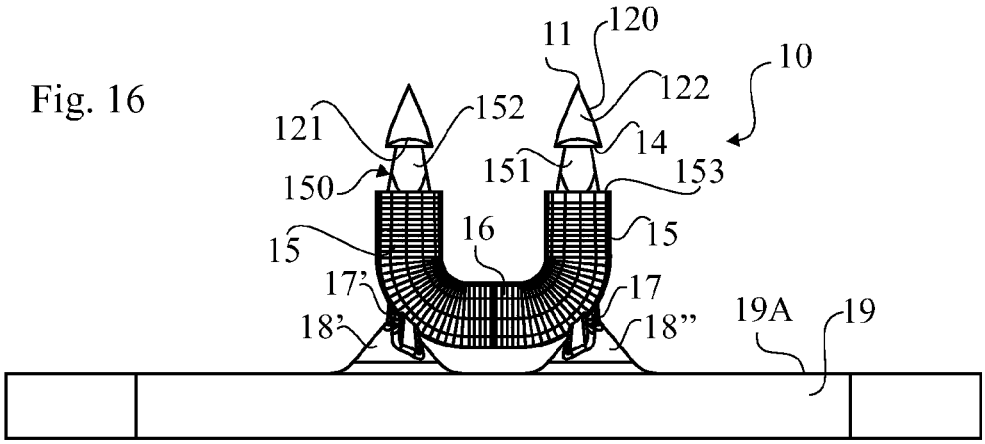
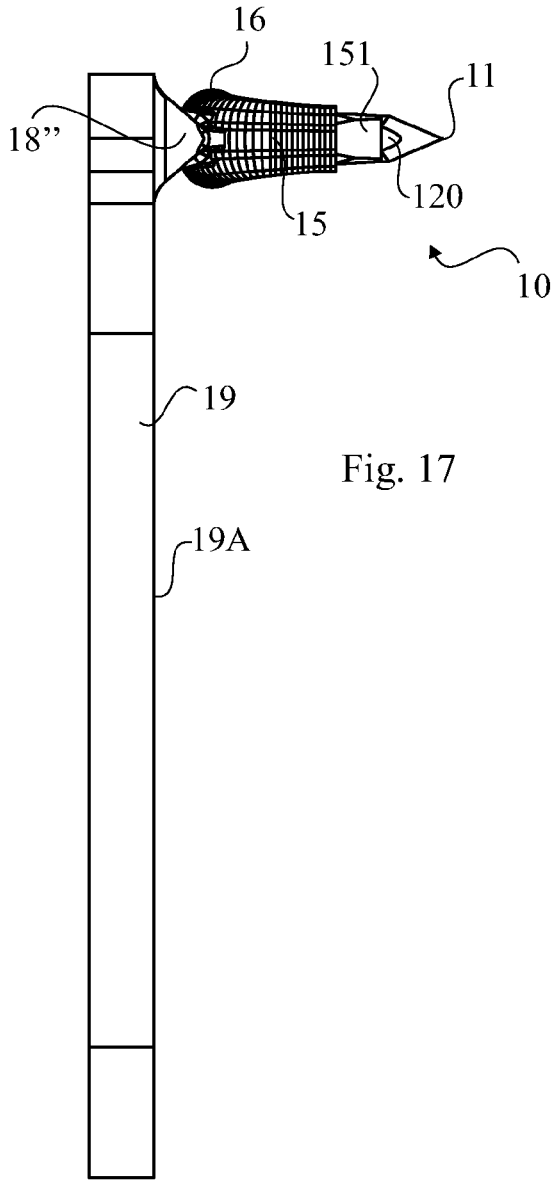
Fig. 17

Fig. 18
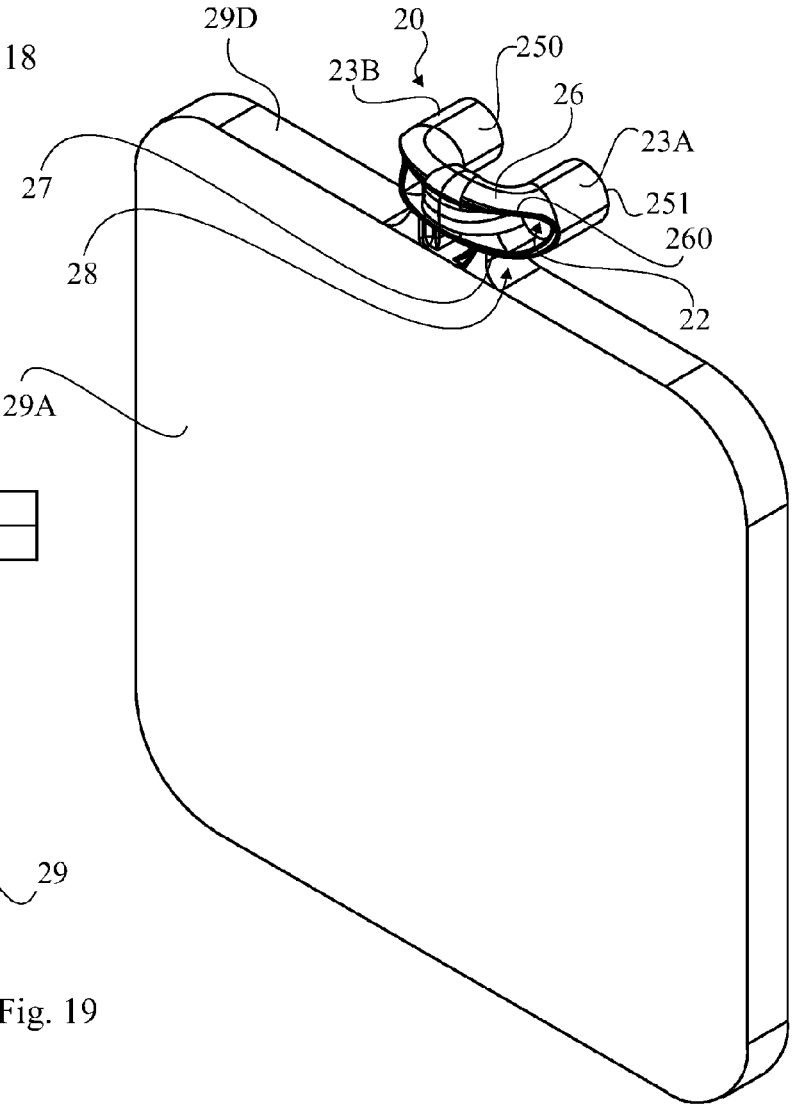
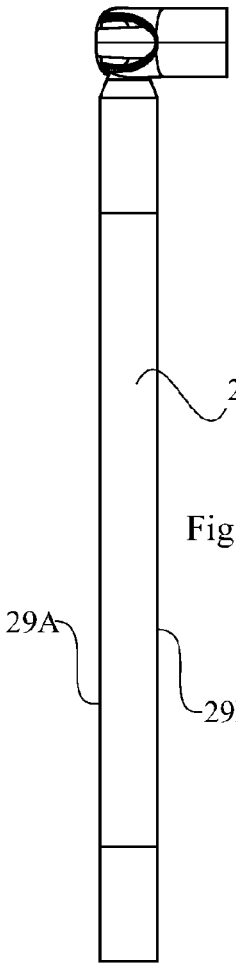
Fig. 19

BUTTON FASTENER AND METHOD OF FASTENING A BUTTON

CROSS-REFERENCE TO RELATED APPLICATIONS

This application is a national stage entry under 35 U.S.C. 371 of International Application No. PCT/SE2009/050956, filed 25 Aug. 2009, designating the United States. This application claims foreign priority under 35 U.S.C. 119 and 365 to Swedish Patent Application No. 0801832-7, filed 36 Aug. 2008. The complete contents of these applications are incorporated herein by reference.

TECHNICAL FIELD

A button fastener, comprising a penetrating part and receiving part, wherein the penetrating part is substantially u-shaped by means of having a transversal base with two parallel legs, each of said legs having a pointed end and a retaining member adjacent said pointed end arranged to interlock with the receiving part, and wherein said receiving part is u-shaped with at least one transversal base part and at a position at distance from said base part an interlocking receiving member arranged to interlock with said penetrating part.

PRIOR ART

Buttons of today are most often perforated by of two or four holes, by means of which in connection with a thread or similar the button may be fastened on a cloth. A button is traditionally fastened by first threading a needle and then by sewing the button onto a cloth and thereafter securing the thread.

Buttons are foremost used together with clothing, but many other areas of usage do exist. Buttons are used in different cultures in the whole world, without any existing general standard, which makes the problem regarding lost buttons a wide problem. Buttons are especially frequently used on shirts. Concerning shirts the problem is accentuated since shirts often are used in formal situations where it is especially inappropriate to be without a button. Moreover, buttons easily disappear in connection with losing them, if not directly, later due to inability of being able to quickly refasten the button.

The problem with lost buttons has existed for a very long time independent of shifting trends and most likely it will therefore also remain in the future. A number of trends indeed indicate that the problem will become even more relevant in the future. Numerous countries in the world are in the process of shifting the economy to a higher level which will lead to an increased usage of shirts.

The expansion of the production industry has in certain aspects suffered from a decrease in quality, which causes more lost buttons. Other relevant trends are that people do travel more and more and that time is getting more precious. The following problems have been indentified regarding traditional fastening of buttons:

- It is time consuming to fetch the utilities for sewing and to sew lost buttons onto a clothing.
- It is complicated to fasten a button due to the fact that several utilities are needed, at least needle and thread, sometimes also other products.
- There is a need of education/training to fasten a button according to the traditional method.
- The ability of getting hold of needle and thread, in connection with losing a button, is not always easily solved, especially since it often occurs outside of the residence. Accordingly, utilities are often not available when needed.
- There is a need of fine dexterity and good eyes to thread the needle and also to fasten the thread. Elderly people and disabled individuals have special difficulties in performing the operation.

Other areas may also suffer from the above kind of problems, e.g. the furniture industry and the packaging industry.

There exist numerous different solutions attempting to solve the above mentioned, well known, problem/s. However, none of these known solutions seem to have solved the problem/s without also creating some disadvantages.

The first group may be represented by GP19122229 and U.S. Pat. No. 4,773,343, wherein the basic principle relies in using a short pre-prepared thread arranged with sharp pointed end devices intended to eliminate the need of a needle. However, such a solution still requires some training and/or skill to fasten a button.

GP1401751 and U.S. Pat. No. 433,182 may be seen to represent a second group wherein, compared to the first group, the utility is also arranged with a fastening mechanism to eliminate the need of securing the thread in traditional manner. However, also these utilities require a certain degree of skill and/or training and furthermore the fastening mechanism will normally protrude in some manner that may jeopardize the comfort of the clothing.

GB 191501945, GB191007663, U.S. Pat. No. 1,598,597 and WO99/48398 represent a third group of trying to solve the problem, wherein a penetrating part in combination with a receiving part are used. However, all of these solutions present the common disadvantage that they are relatively difficult to handle due to the fact that the parts must be relatively small.

SUMMARY OF THE INVENTION

It is an object of the invention to eliminate or at least minimize some of the above mentioned problems, which is achieved by means of a button fastener in accordance with the appended claims.

Thanks to the invention there is provided a new kind of button fastener that enables quick, easy and reliable attachment of buttons. A further advantage according to the invention is that it may be produced in a very cost efficient manner. A further advantage is that it is relatively easy to use, also without any training.

Further advantages and other beneficial aspects of the invention will become apparent from the following description.

Below some aspects will be described regarding advantages that may be obtained by means of the invention, compared to existing solutions.

According to one aspect of one embodiment of the invention the base of the u-shaped part (fulfilling the function of a thread) is arranged with a gripping member attached via a rupture joint. The gripping member makes the handling easier, e.g. by providing the user to a better grip of the part corresponding to the thread and thereby an ability to press with considerable force in a desired direction in connection with penetration of a cloth or a similar material, compared to if the user should try to directly grip onto the part itself. Also in connection with storing of the utility it is an advantage that the gripping member exists to provide a larger size which makes it easier to find.

According to another preferred aspect of the invention, in relation to preferred embodiment, the device after application will give the impression of a traditional fastening both seen from the front side and from the backside of the button and cloth.

According to another preferred aspects the retaining mechanism will be hidden within the holes of the button which provides for a good comfort in relation to the skin, e.g. in the same manner as according to fastening of a traditional kind. This feature is available without the need of performing any further actions. Furthermore the hiding of the snap-in retaining mechanism in the holes provides for a very little difference in the visual appearance between button fastened in a traditional manner and a button fastened according to the invention. No difference may be seen at all from a sufficient distance, i.e. at which most observers normally will be positioned. Also this advantage is gained without the need of any further action.

According to a further aspect the design is such that it will allow production with use of very small tolerances.

According to another preferred aspect the invention is in the form of a system wherein the gripping member, the receiving part and the penetrating part are supplied in one unit prior to use, wherein first the receiving part is detached in connection with use and the gripping members are detached after the button has been fastened.

According to another preferred aspect the sharp edges of the retaining members of the penetrating part, e.g. in the form of barbs, are positioned to minimize that these sharp edges rub against contacting material during storage.

BRIEF DESCRIPTION OF THE FIGURES

In the following the invention will be described more in detail with reference embodiments shown in the appended figures, wherein:

FIGS. 1 and 2 show two different side views of a first embodiment of a penetrating part according to the invention, FIG. 3 shows the embodiment in FIGS. 1 and 2 from above, FIG. 4 shows a perspective view of the embodiment of FIGS. 1-3, FIGS. 5 and 6 show a first embodiment of a receiving part according to the invention in two different side views, FIG. 7 shows the embodiment in FIGS. 5 and 6 from above, FIG. 8 shows the embodiment of FIGS. 5-7 in a perspective view, FIGS. 9A-9E sequentially present a method for fastening a button in accordance with the invention.

FIGS. 15-17 show a further embodiment of a penetrating part according to the invention, FIGS. 18-20 show a further embodiment of a receiving part of the invention.

DETAILED DESCRIPTION

Figure 9A:
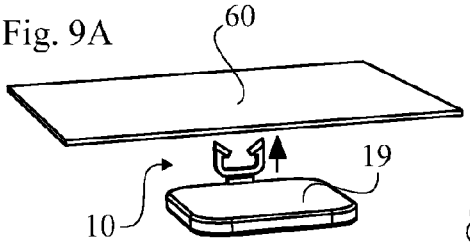

In FIGS. 1 and 2 there are shown two different side views of a penetrating part 10 according to the invention, in accordance with a first embodiment. In FIG. 3 the same embodiment is shown from above and in FIG. 4 in a perspective view. The penetrating part 10 is generally u-shaped, comprising a transversal base 16 and two parallel legs 15A. Pointed end 11 is arranged at the outer end of each leg 15. From each pointed end 11 there extends an edge 110 inwardly towards the centre of the u, which edge 110 at its inner position terminates in conjunction with an inwardly protruding portion 122, that forms a retaining member 14, generally in the form of a barb. The penetrating device 10 is fixedly attached to a gripping member 19 by means of a breakable connection 17, i.e. presenting a line of rupture. As shown the line of rupture 17 is preferably arranged by providing a stub member 18 that protrudes a distance up from the gripping member 19. The gripping member 19 may have any desired form but a substantially rectangular shape as presented in the figures present some advantages in some situations, e.g. by providing straight side edges that may be used in connection with positioning of the button fastener, in accordance with the invention. As can be seen the u-shaped penetrating device 10 is preferably positioned with its transversal base 16 substantially in line with one of the side edges of the gripping member 19 and the legs 15 extending perpendicularly in relation to the extension of a central plane parallel with the grippable wide surfaces of the gripping member 19.

In FIGS. 5-6 there are shown two different side views of a receiving part 20 according to the invention. In FIG. 7 there is a view from below and in FIG. 8 there is shown a perspective view. Many aspects of the basic design principles also apply for the receiving part 20 as for the penetrating part 10, e.g. regarding the gripping member 29 and the positioning and attachment of the receiving part 20 therefore. The shape of the receiving part 20 is similar in that it is generally u-shaped, but presents some differences to present reliable interaction with the penetrating part 10. Seen in a first side view, as in FIG. 5, it presents a u-shape by means of transversal base 26 and two leg members 23A, 23B. The transversal base 26 will provide the visible portion when attached to a button, i.e. the base 26 will give the impression of a thread. Adjacent the ends 21, 21', of the legs 23A, 23B there are provided receiving means 22, in the form of receiving surfaces 22', 22", intended for interaction with the retaining members 14, of the penetrating part 10.

As can be seen in the figures the retaining surfaces 22', 22" are formed by the inner surface of each leg end portion 21, 21'. These leg end portions 21, 21' also form bridging portions for a further pair of legs 23A', 23B'. The further leg portions 23A', 23B' are interconnected between each other by a second base member 26' (positioned parallel with the first transversal base 26), such that the receiving part 20 forms an endless loop, wherein the cross sectional area of the threadlike material in the loop is substantially the same everywhere. Via the second base portion 26' the receiving part 10 is detachably fixed to the gripping portion 29 by means of a protruding portion 28 from the gripping member 29. Between the protruding portion 28 and the second base member 26' there is a joint of rupture 27, to facilitate easy detaching of the receiving part 20 from the gripping portion 29.

As can be seen from all figures described above the gripping portion 19, 29, especially in connection with manual use, preferably is much larger than the transversal extension of the penetrating part 10 and receiving part 20 respectively, which generally corresponds to the length of the transversal base 16; 26. In some applications the gripping member 19, 29 may be ten times bigger than the penetrating/receiving part 10, 20, or even larger if that may be desirable for any reason. As shown the gripping member 19, 29 may be shaped as a rectangle (which provide certain advantages as described above) but many various shapes are of course possible, e.g. to provide the gripping member 19, 29 in the form of a logo type. As already mentioned the proportions between that part which is left 10, 20 after fastening and the gripping member 19, 29 can vary depending on where the product is to be used.

The parts are preferably produced in some kind of rigid or semi-rigid material, for instance plastic or metal. Each part that provides some flexibility/resiliency, preferably both parts, may either be produced in one and the same material or be produced from different materials in different parts to fulfill certain demands, e.g. regarding strength, flexibility and environmental friendliness. Many different methods of production are feasible.

As shown in FIGS. 1-4 there may be provided tapering surfaces 12, to form the pointed end 11 and also to provide an edge 110 that in conjunction with the retaining member 14, will provide a barb like body portion 122, to increase the ability of penetrating a cloth or a similar material onto which a button is to be fastened. Thanks to the tapering surfaces 12 there is provided conditions for having a wide barb like body portion 122, having ability to assist regarding penetration and retaining/locking respectively. The tapering surfaces 12 may start from a base 13 which forms inclined line running all the way to the end of the retaining protrusion 14 as is shown in FIG. 1. As already mentioned above, the legs 15 of the penetrating part are joined by the transversal base 16 which after fastening will be visible from the underside of the cloth. The length of the transversal base member 16 is sufficient to allow the protruding legs 15 to fit into buttons that are common on the market. The length of the penetrating legs 15 are such that the retaining members 14 will be positioned at sufficient distance away from above the cloth.

The leg portions 23A, 23A', 23B, 23B' of the receiving part 20 are sufficiently long to allow it, together with the legs 15 of the penetrating part 10 to reach through the button and the cloth. The width of the upper side 26, 26' of the receiving part 10 is sufficient to fit buttons which are common on the market. The width of the upper part 26, 26' may vary to fit different types of buttons. By the use of a flexible material and curved portions 25 the widths may to some extent be adjustable, due to allowing flexing between the legs and the base 26'.

The cross sectional profile of the thread-like material of the receiving part and/or penetrating part respectively, may be substantially rectangular with rounded edges as indicated in FIGS. 5-8, but many different shapes are of course possible, e.g. circular or another specific shape that of some reason may be beneficial/desired.

The shape/design of the penetrating part 10 and/or the receiving part 20, with its gripping portion 19;29 may vary depending on method of production, e.g. to optimize in relation to a chosen method of production. Form molding may be used, freeform production, thread forming and/or cutting methods. It is evident that the above mentioned production methods merely relate to suggestions and that within each area there exists a number of different methods which can be used and that there also exist other kinds of production methods that may be appropriate.

Figure 21:
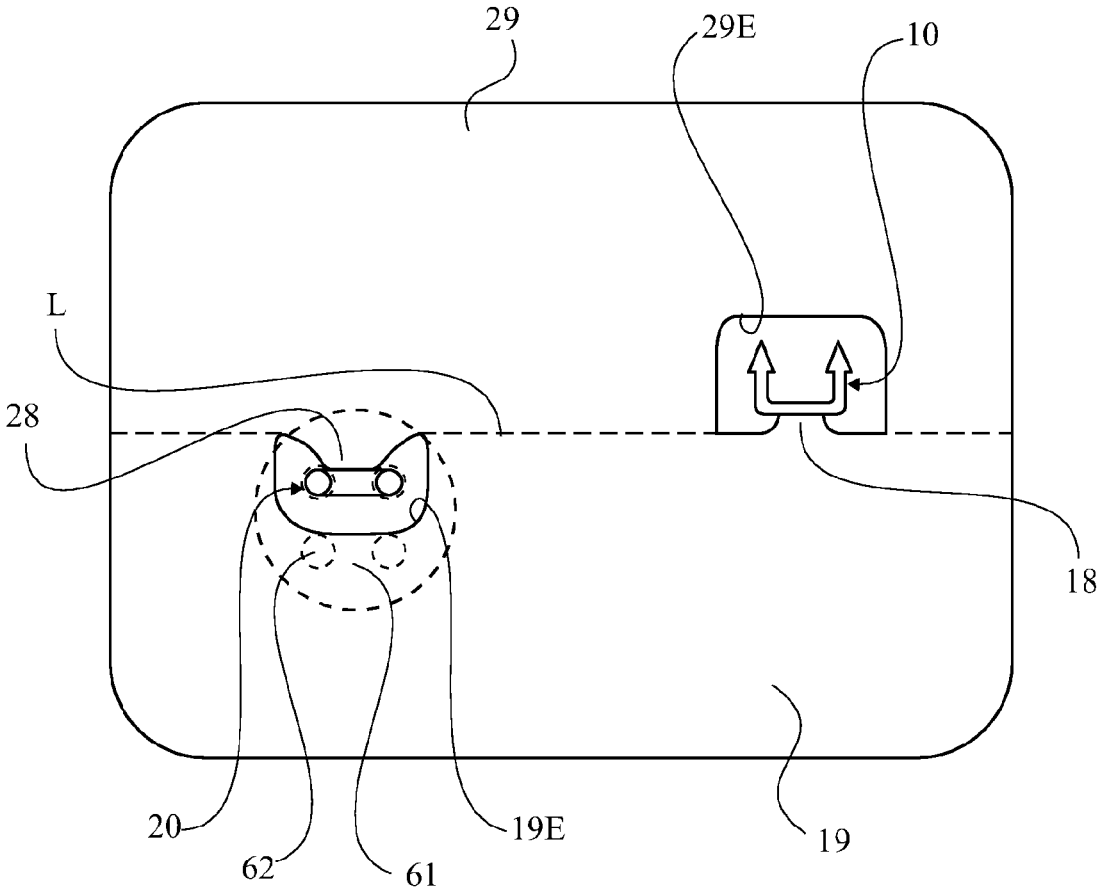
FIG. 21 shows a preferred embodiment of all parts of the invention forming one unit prior to use.

In one mode, as shown in a preferred embodiment of FIG. 21, all parts of the invention form one unit prior to use, which provides an advantage in that it is easier to keep and to locate the parts prior to use, and also that the arrangement of the unit may be such that sharp part do not protrude outside thereof. In FIG. 21 this is provided by producing the unit to have the gripping member 19, 29 extending in the same plane, joined by perforated line L of rupture. Further within the gripping member 19 of the first part 10 there is made an open space presenting a U-shaped edge 19E that has its starting point in the rupture line L. Within the open space the receiving part 20 is positioned, such that it will be protected, by means of having the protruding portion 28 extending from its gripping member 29 beyond that long side which is formed by the rupture line L. In a similar manner the protruding portion 18 of penetrating part 10 protrudes into an open space arranged within a U-shaped edge 29E within the other gripping member 29. The penetrating part 10 is positioned to longitudinally protrude in the same plane as the gripping members 19, 29, thereby having the pointed ends 11 totally protected within the edges 29E. The receiving part 20 is positioned turned 90° such that it's legs will protrude transversally out from the common plane, which provides the advantage that a button 61 may then be located thereon (prior to use) by means of it's holes 62, and will then protect the protruding legs 16 at the same time as the legs will secure the button 61 to the unit. In connection with use, first the rupture line L between the penetrating member 10 and the receiving member 20 is detached.

Figure 9B:
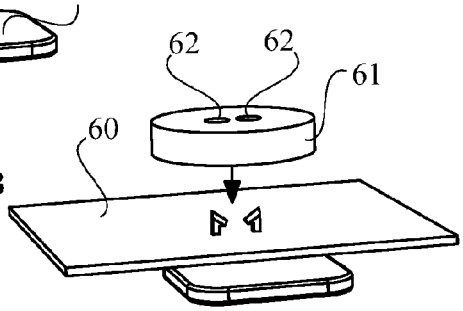
Figure 9C:
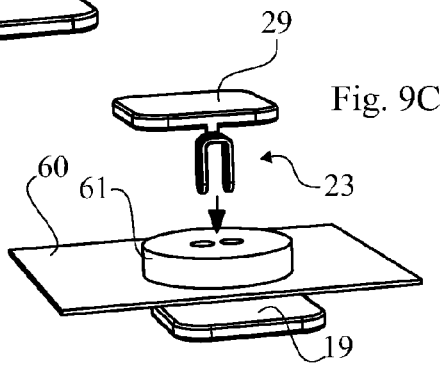
Figure 9D:
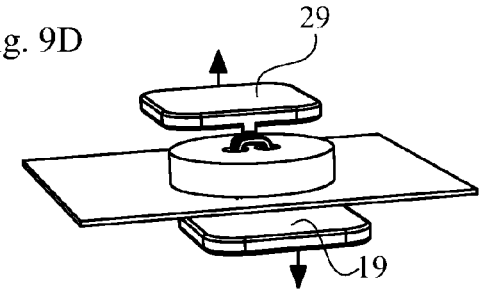
Figure 9E:
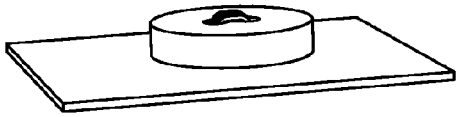
Figure 10:
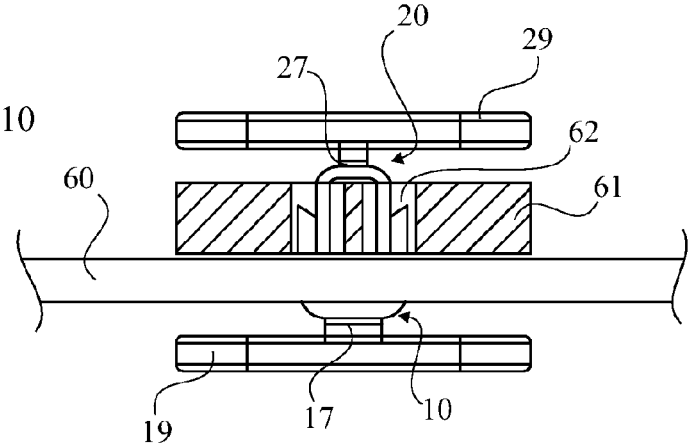
FIG. 10 presents a side view of a button fastened with the device in accordance with the invention prior to detaching the gripping members.

In FIGS. 9A-9E there is sequentially presented the principles of the method for fastening a button in accordance with the invention. Here, at first, the pointed ends 11 of the penetrating part 10, are brought through the cloth 60 from the underside thereof, as shown in FIGS. 9A and 9B. As is evident the rectangular shape of the gripping member 19 may assist to line up by holding the sides of the gripping member 19 substantially parallel (and perpendicularly respectively) in relation to the edge of the cloth 60. In the next step a button 61 is positioned onto the pointed ends 11 of the penetrating, to allow the pointed ends and a part of the legs 15 to penetrate into the holes 62 of the button 61. It is evident that the above described steps may be performed in an inverted manner. As shown in FIG. 9C in the next step the legs 23 of the retaining part 10 are penetrated from above into the holes 62 of the button 61. When the two parts 10, 20 get in contact with each other they will interlock (see FIG. 9D) by having the retaining member 14 of the penetrating part 10 inter-fitting with receiving surfaces 22', 22" of the receiving part 20, see FIG. 10. Once the button 61 is fastened by means of the parts 10, 20 the gripping members 19, 29 are detached, as indicated in FIG. 9E. Thereafter merely a thread like part 26, 26' of the invention will be visible from the front side of the cloth.

Figure 11:
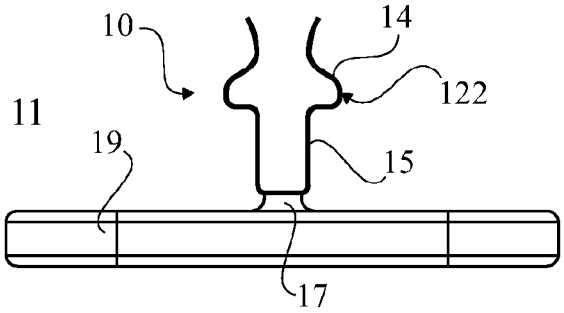
FIG. 11 shows a side view of second embodiment of a penetrating part according to the invention.

In FIG. 11 there is shown further embodiment of a penetrating part 10 in accordance with the invention, where the material in the protruding portions 11, 14, 15 is so thin that there is no need for a tapering portion. Thanks to the thin material a sufficiently pointed end 11 will be created naturally by the material. Further FIG. 11 depicts that the retaining member 14 may be inversely arranged (compared to what is shown in FIGS. 1-4) by protruding in opposite directions away from the centre of the u-shape. In this embodiment the retaining member 14 is created by forming the wire like material to protrude and form a retaining surface 14, similar to that formed by the barb like member in FIGS. 1-4. It is evident that the radius of the curvatures and the number of bendings may vary to provide desired shape and/or strength. Another possible solution, when using a wire like material in the penetrating part 10, would be to arrange for guiding grooves (not shown) in the receiving part 20 that automatically bends and locks the pointed ends 11 such that they are locked/retained within the receiving part 20. Another possible solution would be to use cylinder like legs of the receiving part 20 (not shown) adapted to interlock with the wire like ends 11 of the penetrating part either by friction or by the use of grooves or protrusions within the cylinder.

Figure 12:
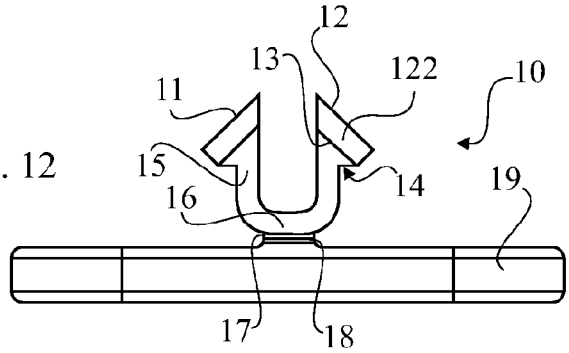
FIG. 12 shows a side view of a third embodiment of penetrating part according to the invention.

In FIG. 12 there is shown a further embodiment of a penetrating part 10 according to the invention, where (as in FIG. 11) the retaining members 14 are directed in opposite directions compared to FIGS. 1-4. This embodiment may present advantages regarding robustness.

Figure 13:
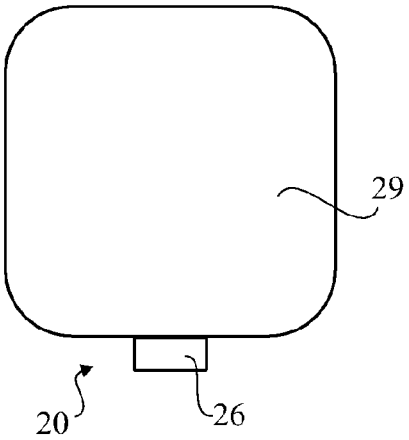
FIGS. 13 and 14 show a view from above and from the side respectively of second embodiment of a receiving part according to the invention.
Figure 14:
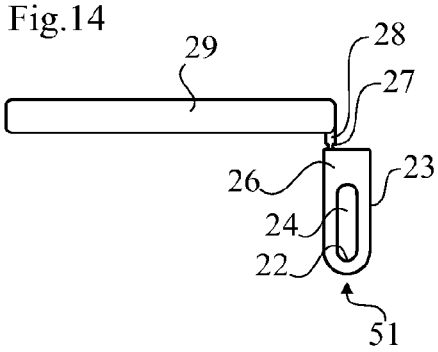

In FIGS. 13 and 14 there is shown a further embodiment of a receiving part 20 according to the invention, wherein FIG. 13 is a view from above and FIG. 14 is a side view. In this embodiment the upper, visible part 26 is in the form of a single unit and the receiving means 22, will then be formed by arranging holes 24 in each leg portion 23 of the u-shaped receiving part 20.

Figure 15:
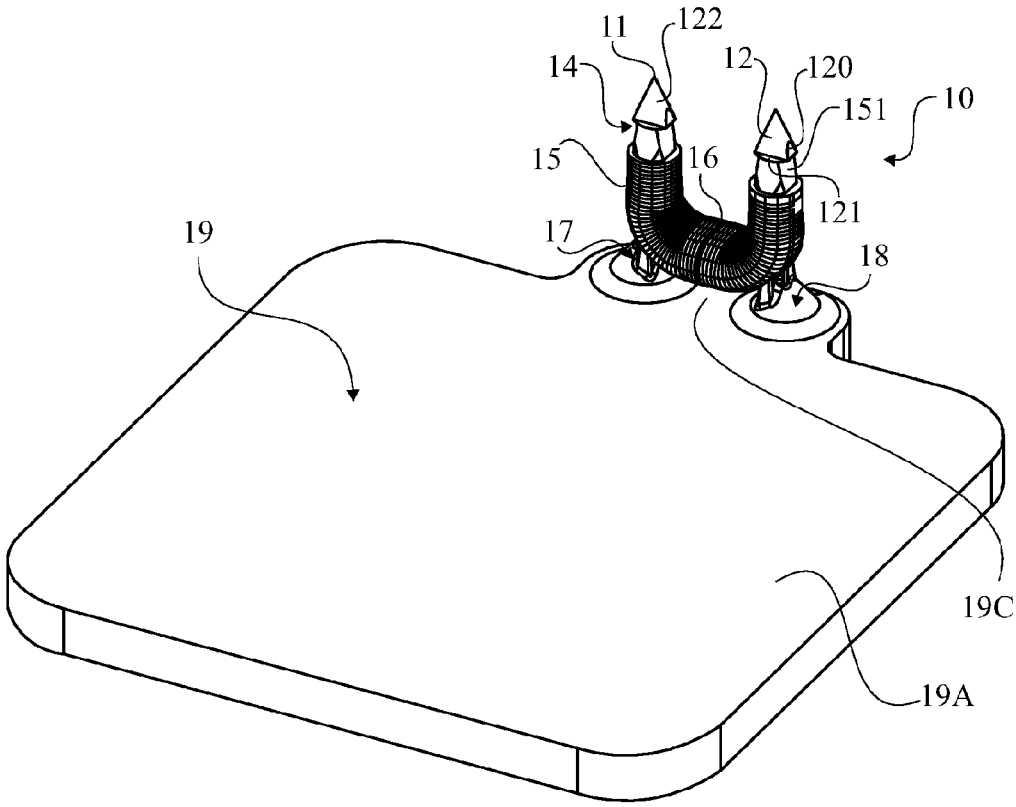

In FIGS. 15-17 there is shown a further embodiment of a penetrating part 10 in accordance with the invention, where FIG. 15 presents a perspective view, FIG. 16 a first side view and FIG. 17 a second side view that is perpendicular in relation to FIG. 16. The basic principles of the embodiment shown in FIGS. 15-17 are the same as has been described above, as indicated by the use of the same reference numerals, and therefore in following there is focus on presenting differences regarding details of this further embodiment. A first difference is that the barb like body portions 122 in this embodiment are formed by the use of conically tapering surfaces 12 ending up with the pointed ends 11. Further the width i.e. the transversal cross-sectional extension, of the barb like body portion 122 is smaller than the width of a leg portion 15. This is achieved by providing an intermediate body portion 152, between an edge 153, that defines the end of a wider extension of each leg 15, and the barb like body portion 122. The intermediate body portion 152 has a smaller cross-sectional width than the actual leg portion 15. This body portion 152 is formed such that its upper part provides for arranging protruding retaining surfaces 14 that form the inner transition zone of the barb like portions 122. The retaining surfaces 14 are positioned on two opposite sides on each barb like body portion 122, in line with the longitudinal extension of the transversal base member 16. Moreover, there is shown that there are arranged cut out areas 120,121 within the barb like body portion 122, which cut out areas 121,121 are provided for enabling easier penetration of the penetrating part 10 into the receiving part 20.

Further it is shown that the widest cross-sectional extension of the penetrating part 10 belongs to the transversal base member 16, such that its width in one extension will be wider than the diameter of the legs 15, which legs 15 have substantially circular cross-sections. In a side view (presenting the two legs 15 next to each other, as shown in FIG. 16) however the cross-sectional width of the base portion 16 preferably is substantially the same as the diameter of the legs 15.

A further modification is that the penetrating part 10 is detachably arranged onto the gripping member 19 by means of two protruding portions 28',28", generally in the form of cones protruding outwardly in relation to flat wide side 19A of the gripping member 19. Further it is shown that the protruding portions 28',28" are positioned on a small extra part 19C that (is integrated with but) protrudes sideways in relation to the main portion 19 of the gripping member 19. The joint of rupture 27 between the receiving part 10 and each protruding portion 28',28" is in the form of a number of minor interconnecting bridges 27',27", which are positioned adjacent end sections of the transversal base member 16, i.e. in the transition zone between the transversal base member 16 and each leg 15.

Figure 20:
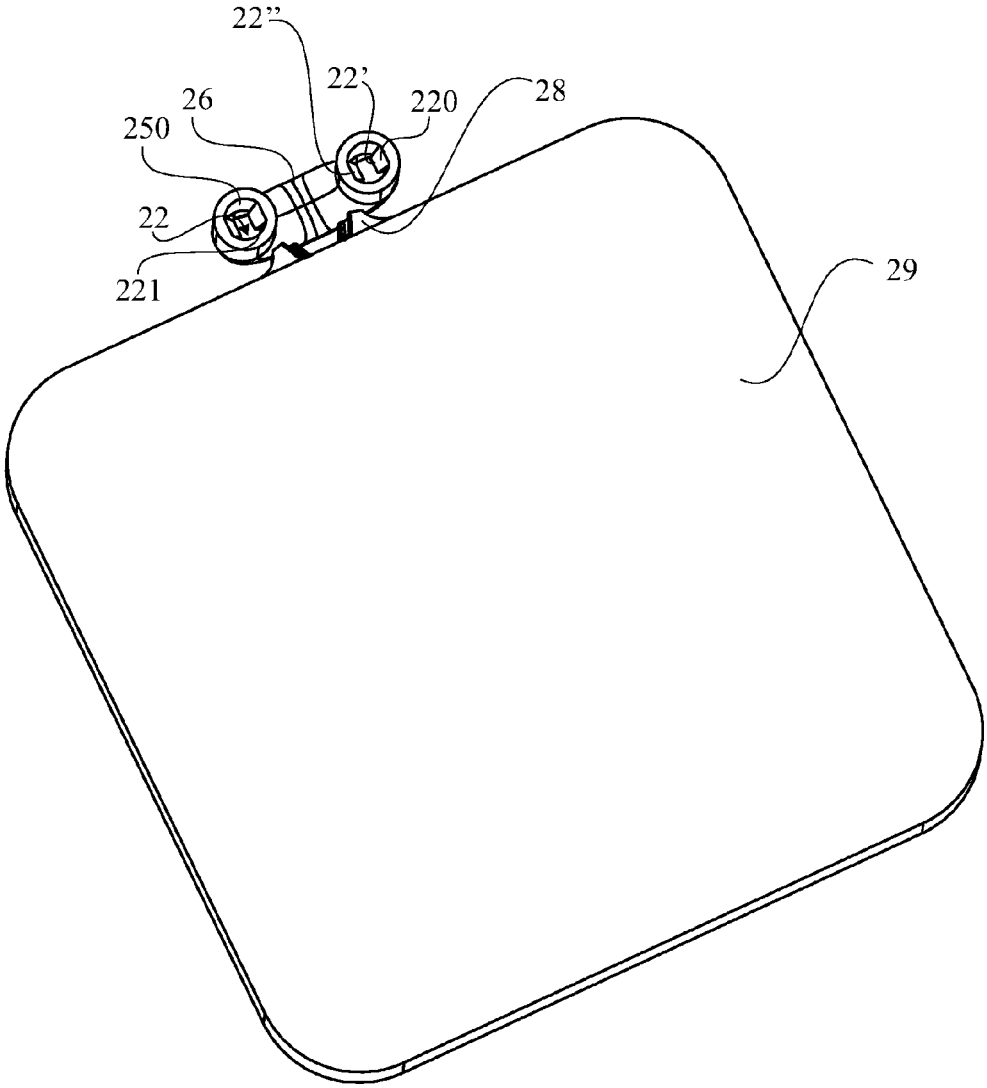

In FIGS. 18-20 there is shown a receiving part 10 intended for interaction with a penetrating part 10 as described in FIGS. 15-17, wherein FIG. 18 is a perspective view, FIG. 9 a first view from the side and FIG. 20 a perspective view from the second side. As with the penetrating part in FIGS. 15-16 the basic principles are similar to what has already been described and therefore there will be a focus on differences. A major difference is that the receiving means 22 are arranged within tubular portions 250 that are formed by the legs 25 of the receiving part 20. In the side walls of each tubular member 250 there is arranged a first 22' and a second 22" receiving member, which are triangularly shaped to present tapering surfaces 220, that facilitate easy penetration of the barb like body portion 122 of the penetrating part 10. Hence, the receiving members 22',22", will also form surfaces 221 that protrude perpendicularly in relation to the inner wall of the tubular member 250, which surfaces 221 are intended for interaction with the retaining member 14 of the penetrating part 10. Further also the receiving part 20 presents a similar shape of its transversal base 26 as the penetrating part 10, i.e. presenting an oval shaped cross-section to have the transversal base 26 wider than the diameter of the tubular legs 25 in one extension. The arrangement of the rupture joint 27, 28 has a similar structure as described above, but the protruding portion 28 is here positioned at on of the side edges 19D of the gripping member 19.

Moreover its is shown that the outer side of the transversal base 26 of the of the receiving part 20 is open by presenting an edge 260 that generally extends along the periphery of the transversal base, seen from a side facing the upper side 29A of the gripping member 29. Accordingly this edge 260 will present a wide opening that allows the pointed ends 11 of the penetrating part 10 to be introduced further than would have been the case if the tubular walls would have been maintained everywhere. Further the edges 251 of the tubular leg portions 250 will provide edges that interact with the edges 153 of the penetrating leg portions 15, to define an end stop for the parts 10,20 when attached to each other, i.e. the receiving means 22 will snap into the space behind the retaining members 14 prior to or in connection with getting the edges 151,153 in contact with each other, thereby providing a distinct feeling of sufficient interaction.

The scope of the invention is not limited to what is described above, but may be varied within the ambit of the appended claims. For instance, besides varying the form of the gripping member they may also be used to provide printed information, e.g. instructions of how to use the invention. Another evident modification is that if a sufficiently strong material is being used it will suffice with one base member 26 in the receiving part 20 shown in FIGS. 5-6 and to merely use a curved end 21 at the end of the legs 23A, 23' to provide retaining means 22. Further in some embodiments it may suffice to merely use friction and/or clamping action to keep the parts together, i.e. possibly eliminating the need of a barb like body portion 122. As already mentioned the gripping members 19, 29 may have various shapes depending on needs/desires. Further it is evident that the penetrating/receiving part 10/20 may be positioned at various locations on the gripping members 19, 29, e.g. substantially centrally which may make it easier to apply a higher pressure, if needed. However, for manual use it may be an advantage to position at least one of the parts 10/20, at least slightly at the side of the base of the gripping member 19/29 (see figs., since it will make it easier to visually control the insertion thereof. Moreover it is evident that the rupture joint 27 may be in form of numerous small "bridges", and that the joint may be positioned at various places on the penetrating/receiving part 10/20 (now on the back side of/adjacent the base 16/26), e.g on the side of, or on the inside of the base 16/26. Further, it may be desired to form a recess the penetrating/receiving part 10/20, where the bridge 27 is integrated, to eliminate protruding rests, that might otherwise rub against the skin of the user. in are of course possible, e.g. to provide the gripping member 19, 29 in the form of a logo type. can vary depending on where the product is to be used. Finally, it is evident that many of the described aspect may be the subject of their own patent application, without limitation to specifics described in connection with the shown embodiments.

The invention claimed is:

1. A button fastener comprising:

a penetrating part;

a receiving part, wherein said penetrating part is substantially U-shaped by means of having a transversal base with two substantially parallel legs, each of said legs having a pointed end and a retaining member adjacent said pointed end arranged to interlock with said receiving part, and wherein said receiving part is substantially U-shaped with at least one transversal base and at a position at a distance from said transversal base an interlocking receiving means arranged to interlock with said penetrating part; and a detachable gripping member detachably connected to at least one of the transverse base of the penetrating part or to the receiving part by a breakable connection, wherein the gripping member is detachable by means of a line of rupture.

2. The button fastener according to claim 1, wherein said retaining member is protruding.

3. The button fastener according to claim 2, wherein said transversal base of the receiving part is arranged with said detachable gripping member.

4. A button fastener according to claim 2, wherein said protruding retaining member together with a body portion comprising each respective pointed end form barb like portions.

5. A button fastener according to claim 4, wherein said barb like portions are symmetrically positioned in relation to a centre line of the U-shaped part.

6. A button fastener according to claim 5, wherein said protruding retaining members protrude in directions to face each other.

7. The button fastener according to claim 1, wherein said transversal base of said penetrating part is arranged with said detachable gripping member.

8. A button fastener according to claim 1, wherein said penetrating part and said receiving part are arranged as one single unit.

9. A button fastener according to claim 8, wherein said penetrating part and said receiving part are attached to each other by means of a releasable attachment.

10. A button fastener according to claim 9, wherein said releasable attachment is in the form of a line of rupture.

11. A button fastener according to claim 1, wherein at least one of said parts is made in plastic.

12. A button fastener according to claim 1, wherein both parts are made in plastic.

13. A method for fastening a button comprising:

providing a penetrating part and a receiving part, wherein said penetrating part is substantially U-shaped by means of having a transversal base with two substantially parallel legs, each of said legs having a pointed end and a retaining member adjacent said pointed end arranged to interlock with said receiving part, and wherein said receiving part is substantially U-shaped with at least one transversal base and at a position at a distance from said transversal base an interlocking receiving means arranged to interlock with said penetrating part;

providing at least one of said parts with a detachable gripping portion detachably connected to at least one of the transverse base of the penetrating part or to the receiving part by a breakable connection, wherein the gripping portion is detachable by means of a line of rupture;

bringing said pointed ends of said penetrating part through a material;

positioning a button having holes onto said pointed ends of said penetrating part to allow said pointed ends and a part of the legs to penetrate into said holes of said button;

utilizing said at least one gripping portion to interconnect said penetrating part and said receiving part thereby fastening said button; and detaching said gripping portion.

14. The method according to claim 13, wherein both parts are provided with gripping members.

15. The method according to claim 13, wherein said penetrating member and said receiving member are arranged to form a single unit prior to use.

16. The method according to claim 13, wherein said gripping member is provided in a size arranged to be grip able by a person.

17. The method according to claim 13, wherein said gripping member has a transversal extension that is bigger than the length of said transversal base.

18. The method according to claim 13, wherein said gripping member has a transversal extension that is between 2-10 times bigger than the length of said transversal base.

* * * * *